United States Patent [19]

Ang et al.

[11] Patent Number: 4,607,153

[45] Date of Patent: Aug. 19, 1986

[54] ADAPTIVE GLOW PLUG CONTROLLER

[75] Inventors: Leoncio T. Ang; Robert E. Weber, both of Newport News, Va.

[73] Assignee: Allied Corporation, Morris Township, Morris County, N.J.

[21] Appl. No.: 701,908

[22] Filed: Feb. 15, 1985

[51] Int. Cl.[4] ..... H05B 1/02

[52] U.S. Cl. ..... 219/497; 219/501; 219/202; 219/205; 219/508; 219/505; 123/179 H

[58] Field of Search ..... 219/501, 505, 202, 203, 219/205, 497, 499, 483, 508; 123/179 H, 179 B, 179 BG, 145

[56] References Cited

U.S. PATENT DOCUMENTS

| | | | |
|---|---|---|---|
| 4,159,876 | 7/1979 | Egan | 219/497 |
| 4,283,619 | 8/1981 | Abe | 219/497 |
| 4,399,781 | 8/1983 | Tsukasaki | 219/497 |
| 4,478,181 | 10/1984 | Kikuchi et al. | 219/497 |
| 4,493,298 | 1/1985 | Kawamura | 219/497 |

*Primary Examiner*—M. H. Paschall

*Attorney, Agent, or Firm*—Russel C. Wells; Markell Seitzman

[57] ABSTRACT

An adaptive glow plug controller provides a tracking model temperature means for controlling the application of power to one or more glow plugs in response to the present temperature of the glow plugs. Several control circuits control the maximum time that the power is supplied to the glow plugs and the use of the glow plugs at various temperature levels of the environment and/or the engine.

4 Claims, 7 Drawing Figures

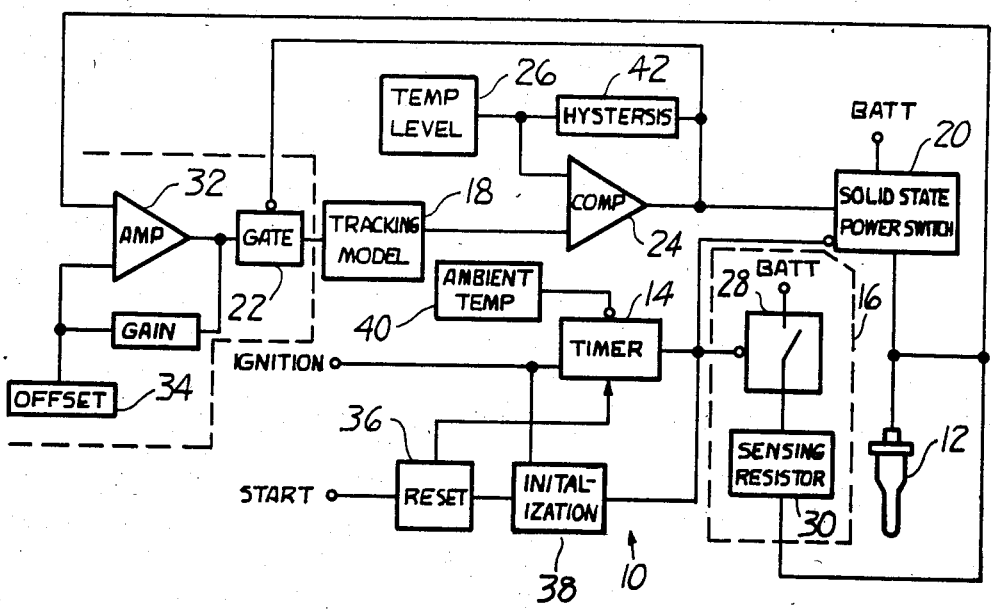
Fig·2
Fig·3
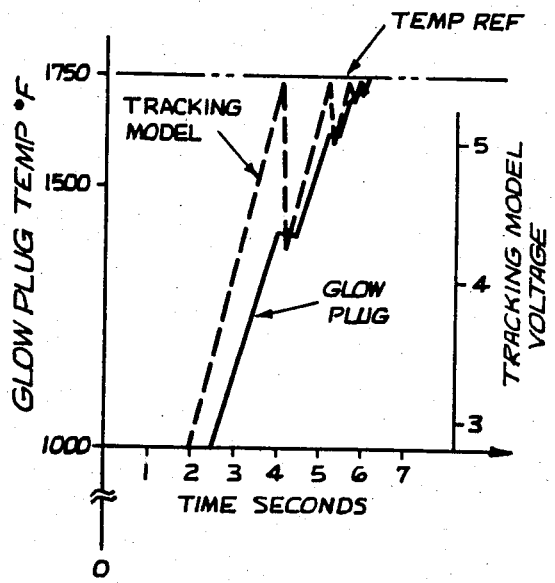
Fig·1
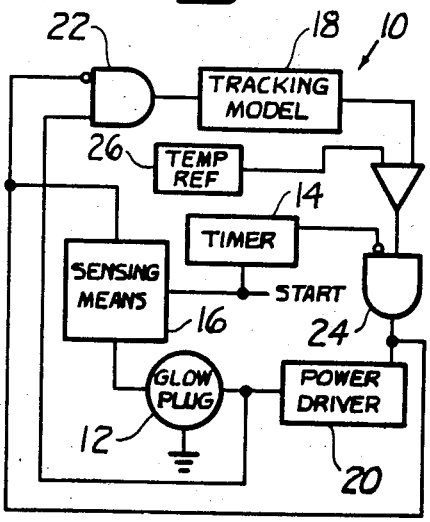

ADAPTIVE GLOW PLUG CONTROLLER

FIELD OF THE INVENTION

This invention relates to glow plug controllers in general and more particularly to an adaptive solid state glow plug controller for controlling glow plugs having a surface film heating element deposited upon a cerâmic substrate.

BACKGROUND OF THE INVENTION

Compression ignition engines or diesel engines rely on the pressure and resultant temperature of the fuel in the cylinder in order to cause ignition to drive the engine. As is well known, in each cylinder it is necessary to provide a glow plug to raise the temperature of the fuel during cold starts and other conditions when the fuel and environmental temperatures are low. Glow plugs are typically wire wound devices having a very low resistance. These devices are electrically connected through a controller across the vehicle batteries drawing heavy current loads. The reason for the low resistance is to generate a high temperature in a short response time.

Controllers for wire wound glow plugs contain one or more relays and one or more relay contacts in the circuit in order to open and close the power path to the glow plug. This opening and closing operates to regulate the amount of current flowing to the glow plug as well as turning the glow plug off when the temperature of the engine is sufficient for compression ignition.

Wire wound glow plugs are now being replaced with surface film glow plugs wherein a predetermined temperature coefficient heating material, such as a positive temperature coeffieicnt material is deposited on a ceramic base. This glow plug is then positioned in the cylinder in a manner similar to its wire wound predecessor. The resistance value of the heating material on the glow plug is generally higher than that of the wire wound on the glow plug, however, the heating time of the heating material is much faster than the wire wound. In order to accurately control the heating of the surface film glow plugs, it is necessary to replace the relays and the several contacts with faster acting solid state components.

SUMMARY OF THE INVENTION

In order to solve the above problems, the following adaptive solid state glow plug controller was invented. It is adaptive because the controller responds to the actual glow plug characteristics for controlling the operation of the glow plug. The glow plug controller operates with at least one glow plug having an electrically operated, predetermined temperature coefficient heating element. In particular, such heating element may have a positive temperature coefficient. A sensing means is operatively coupled to the heater for sensing the temperature thereof. A means is responsive to the sensing means and is operative for generating a first electrical signal which is proportional to the actual temperature of the heating element. Another means is operative to generate a second electrical signal which is proportional to a desired or predetermined operating temperature of the heating element. A tracking model responding to the first electrical signal, generates a model temperature electrical signal representation of the thermal rise characteristics of the heating element.

The model temperature electrical signal is compared with the second electrical signal for generating a first level signal when the comparison indicates the actual temperature is less than the desired temperature and a second level signal when the model temperature electrical signal is less than the value of the second electrical signal. The first level signal operates a power supply means to supply power to the glow plug heating element and the second level signal operates to remove the power supplied and to sense the temperature of the heating element.

DESCRIPTION OF THE DRAWINGS

In the Drawings:

FIG. 1 is a basic block diagram of the adaptive controller.

FIG. 2 is a block diagram of a preferred embodiment of the glow plug controller of the present invention.

FIG. 3 is a graph illustrating glow plug temperature plotted against time and further illustrates a voltage correlation in the tracking model component.

DETAILED DESCRIPTION

Operation

Figure 4:
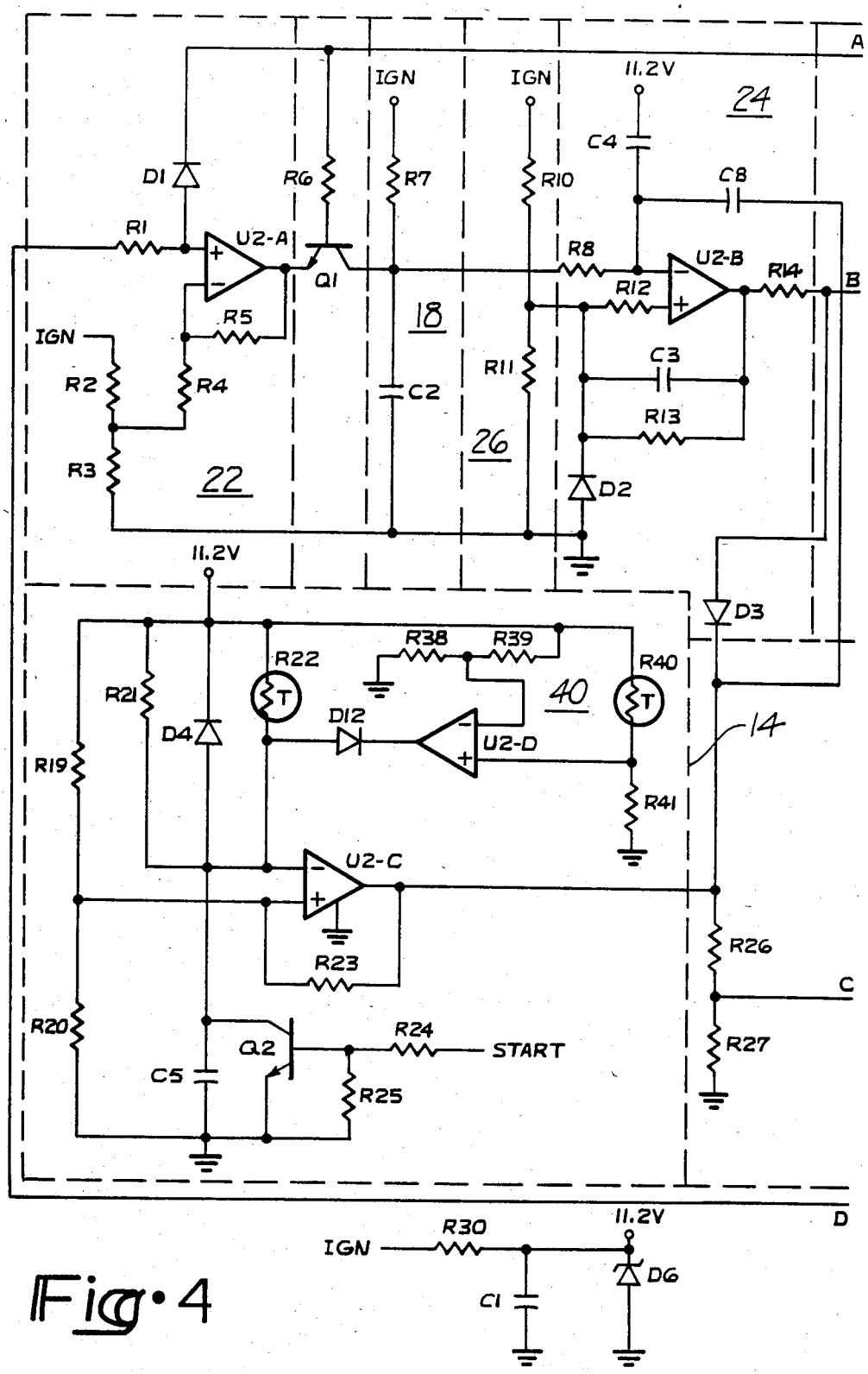
FIGS. 4 and 5 are schematics of the preferred embodiment of the electronic controller according to the present invention.

The adaptive controller 10 for one or more glow plugs R12, illustrated in FIG. 1 in block diagram form, shows the relationship between the several sections of the controller. An example of such glow plugs as may be used herein is found in U.S. Ser. No. 430,909, filed on Sept. 30, 1982 and entitled "Glow Plug Having a Conductive Film Heater" by Mark A. Brooks et al and an improved version of the above-identified glow plug is found in U.S. Patent Application Ser. No. 507,254, filed on June 23, 1983 and entitled "An Improved Glow Plug Having a Resistive Surface Film Heater" by Mark A. Brooks et al. Both of the above are assigned to the same assignee as the present invention and incorporated herein by reference.

Wherr the controller 10 receives a START or IGNITION signal indicating that the glow plugs 12 are to be actuated or energized, a timer 14 is reset and a sensing means 16 is actuated. The function of the timer 14 is to allow the controller 10 to operate for no more than a maximum time. If the engine in which the glow plug 12 has not started and/or is not operated normally by the end of the time signal, the controller 10 will remove power from the glow plug 12. The START or IGNITION signal, by actuating the sensing means 16 upon start up when the ignition key is turned on, will sense the initial temperature of the glow plug 12 and use the initial temperature as the beginning temperature for a tracking model 18 in the controller.

The output of the sensing means 16 and the output of the power driver means or solid state power switch means 20, and the control signal to the power driver 20 are supplied to a logic circuit 22, illustrated as a gate, wherein if the power driver is on, the gate output is off. This, as will hereinafter be shown, prevents sensing the glow plug temperature when power is being supplied to the glow plug to raise its temperature.

The output of the gate 22 is supplied to the glow plug thermal tracking model 18. The function of the model 18 is to generate a ramp voltage signal having a characteristic at least similar to but preferably slightly faster than the thermal rise characteristic of the glow plug 20. It is by the operation of the gate 22 and the tracking model 18 that the controller 10 operates to bring the glow plug 12 up to temperature. The voltage output of the tracking model 18 which is representative of the thermal rise characteristics of the glow plug, is compared 24 with a predetermined voltage level 26 representing the desired operating temperature of the glow plug 12 and if the tracking voltage is lower, the power driver means 20 is actuated supplying power to the glow plugs 12.

If the tracking voltage is higher, the power driver means 20 is turned off, a sensing current is supplied to the glow plug 12 generating a voltage representing the actual temperature of the glow plug 12. This signal is supplied to the logic circuit 22 and under control of the comparator 24 output, the tracking model voltage is updated to the sensing voltage representing actual temperature of the glow plug. Again the tracking model 18 voltage begins to ramp and its voltage level is constantly compared with the predetermined voltage and in response thereto the power switch means 20 is either actuated or remains off.

FIG. 2 represents a more detailed block diagram wherein the several blocks of FIG. 1 are expanded. In particular, the sensing means is illustrated by a switch 28 representation for connecting the battery voltage to a sensing resistor 30. The sensing resistor 30 is connected to at least one glow plug 12 and the junction between the resistor and the glow plug is connected to an amplifier 32. The amplifier is biased by an offset voltage means 34 representing the cold temperature voltage of the glow plug.

The timer 14 is further expanded to illustrate the application of the START signal to not only reset 36 the timer 14 but to generate the initialization 38 signal which initiates the initial temperature check of the glow plug. A second signal called IGNITION of IGN operates to initiate the timer 14. The ambient temperature circuit 40 is connected to the timer 14 to turn it off and not allow it to be turned on when the ambient temperature of the controller 10 environment exceeds a predetermined value.

The comparator 24 is illustrated as an operational amplifier and has a hystersis feed back loop 42 connected thereto.

FIG. 3 is a graphic illustration of the operation of the tracking model 18. The tracking model voltage is a ramp voltage represented by the dashed line curve. As will hereinafter be shown, the tracking model 18 operates on the charging and discharging of a capacitor. The illustrated curve is within the first time constant of the capacitor charge cycle and hence is essentially a straight line. On the right abscissa of the graph is a voltage scale and the left abscissa is a temperature scale. The top ordinate is the predetermined operating temperature of the glow plugs and the bottom ordinate is a time scale measured in seconds. This graph is a representation of a testing done on a controller 10 according to the present invention. FIG. 3 illustrates that when the tracking model 18 is charged to the temperature reference, the battery voltage to the glow plug 12 is turned off and the capacitor is discharged to the glow plug temperature curve which is the solid line.

Analyzing the graph it is apparent that the tracking model 18 including the comparator 24 not only controls the temperature of the glow plug by means of comparing the voltage representations of the actual glow plug and the model, and generates a control signal, but also functions as a pulse width generator to continuously cycle the application of power to the glow plug. Each time that the tracking model voltage exceeds the predetermined reference, the pulse width generator switches state. This causes the capacitor to discharge to the voltage level equivalent to the instantaneous temperature of the glow plug. The period of the pulse width generator is controlled by the hysteresis and the rate which the glow plug temperature decreases.

Circuit Description

Figure 5:
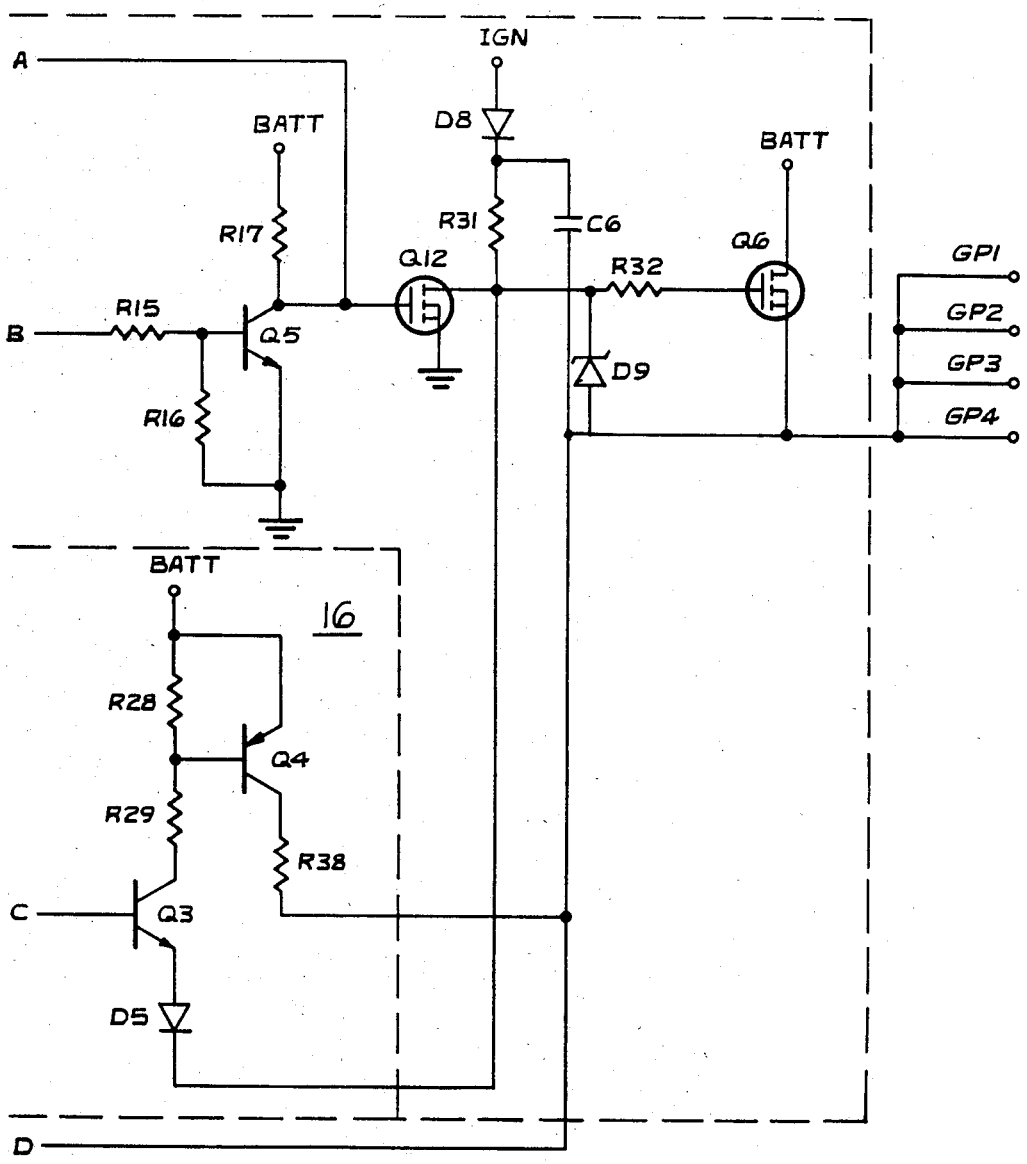

FIGS. 4 and 5 taken together form a schematic drawing of the preferred embodiment of the adaptive solid state controller. The various sections of FIGS. 1 and 2 are sectioned by means of dashed lines. The various components are identified by a reference letter and a numeric wherein the reference letter is generally the first letter of the component name. The embodiment of the controller in this description is in a diesel engine as may be used in a motor vehicle. Such an engine is generally started by means of an operator turning an ignition key in the ignition switch.

The START signal, which is generally generated by an ignition key turning an ignition switch from an off position to a start position, is supplied to a base resistor R24 in the base of a transistor switch Q2. The collector of Q2 is connected to a source of voltage through a parallel path comprising a series resistor R21 and a thermistor R22. The source of voltage, as illustrated, is a regulated voltage generated by the circuit comprising a series resistor R30, a capacitor C1 connected to ground and a zener diode D6 functioning to generate a voltage at the junction of the resistor R30, the capacitor C1 and the cathode of the zener diode. This voltage is labelled 11.2 volts.

The collector of the transistor switch Q2 is also connected to the inverting input of an operational amplifier U2-C, and the anode of a shunt diode D4 and an isolation diode D12. The shunt diode D4 operates in parallel with the thermistor R22 to facilitate a quick discharge of the timing capacitor C5 when the system is turned off. Connected across the emitter-collector of the switch transistor Q2 is a timing capacitor C5. The base of the switching transistor Q2 is connected to ground through the biasing resistor R25.

When the START signal is applied to the switching transistor Q2, the timing capcitor C5 is discharged and is clamped through the collector-emitter circuit of the transistor Q2 to ground until the START signal is removed from the base resistor R24. After the switching transistor Q2 is turned off, the timing capacitor C5 begins to charge through R21 and R22. The charging rate determines the normal time period of the timer.

The noninverting input of the operational amplifier U2-C is connected to a voltage level formed by the resistor voltage dividing network R19 and R20. When C5 charges to a voltage level exceeding that of the non-inverting input, the output of the operational amplifier U2-C is switched to lower level forming a negative going signal in this embodiment. This signal is supplied through the isolation diode D3 to the base of a power switching transistor Q5 to turn the transistor off and turning on the switching transistor Q12 to the power drivers.

The output signal from the operational amplifier U2-C is also supplied to a resistance network R26, R27 to the base of the switching transistor Q3. The function of the switching transistor Q3 and the diode D5 is to control the sensing control transistor Q4 to supply sensing current to the glow plugs being sensed. When the switching transistor Q3 is conducting and the diode D5 is also forward biased; the sensing control transistor Q4 is on and current is supplied through the sensing resistor R38 to the glow plug. When the switching transistor Q3 is off, there is no current flow through the resistors R28, R29 in its collector circuit which forms the base drive circuit of the sensing control transistor Q4. The sensing control transistor Q4 is turned off removing the sensing current to the glow plug.

The switching transistor Q3 is controlled both by the output of the timer and the output of a gate controlled power transistor Q12. When the gate controlled power transistor Q12 is saturated, ground is applied through an isolation diode D5 to the switching transistor Q3. Therefore, the only time that sensing current is supplied to the sensing resistor R38 is when both the timer 14 is on and the output driver Q6 are off.

On the initial ignition key turn on, the timer 14 supplies base current to the switching transistor Q3. Positive going signals through both capacitors C4 and C8 drive the output of a comparator high which turns off the power switching transistor Q5 turning on or saturating the gate control power transistor Q12. As a result, the sensing control transistor Q4 is turned on supplying sensing current to the glow plugs.

The voltage signal developed at the junction of the sensing resistor R38 and the glow plug is supplied to the sensing amplifier U2-A through a resistor R1 to the noninverting input of the sensing amplifier. An offset circuit R2 and R3 establisheing a correct voltage level representing the voltage level of the glow plug at cold temperature is connected to the inverting input of the amplifier U2-A. This voltage level is generated by a voltage divider from the IGN signal and resistors R2, R3. The gain of the amplifier U2-A is determined by the resistors R4 and R5. It is a function of both the offset and the gain circuits of the operational amplifier U2-A to model the glow plug thermal gain characteristics. Thus, when the glow plugs are sensed, the amplifier develops a signal proportional to the temperature of the glow plug.

A clamping diode D1 operates to clamp the noninverting input of the amplifier U2-A to the power switching transistor Q5 when it is saturated. When the power switching transistor Q5 is cut-off, the clamping diode D1 is back biased. The clamping diode D1 functions to prevent the amplifier U2-A from being saturated and introducing undesireable delays in the system.

Electrically connected between the output of the sensing amplifier U2-A and the inverting input of the comparator U2-B is a sampling gate transistor Q1 and a thermal tracking model 18.

As previously stated, the function of the thermal tracking model 18 is to generate a ramping voltage representation of the thermal rise characteristic of the glow plug. It is a function of the sampling gate transistor Q1 when the glow plugs are being sensed, to reset the tracking model 18 to a voltage representing the actual temperature of the glow plugs. In order to accomplish this, the base drive for the sampling gate transistor Q1 is connected through a base resistor R6 to the collector of the power switching transistor Q5. Therefore, when the gate voltage of the controlled power switching transistor Q12 is high because the power switching transistor Q5 is off, the base of the sampling gate transistor Q1 is conducting and the collector-emitter circuit operates to clamp the voltage of the tracking model 18 to the output voltage level of the sensing amplifier U2-A.

The tracking model 18 is a series resistance-capacitance circuit R7, C2 wherein the junction of the resistor R7 and the capacitor C2 is connected to the collector of the sampling gate transistor Q1 and through a series resistor R8 to the inverting input of the comparator operational amplifier U2-B. The capacitor C2 charges through the resistor R7 for generating the ramp electrical signal representing the thermal rise characteristics of the glow plug.

The comparator 24 operates to compare the ramp voltage on the capacitor C2 in the tracking model 18 with the voltage generated by a temperature reference voltage divider circuit comprising resistors R10 and R11. The resistor R10 is adjusted in accordance with the operational characteristics of the glow plug. The function of the temperature reference is to provide a voltage signal proportional to the desired operating temperature of the glow pug. In FIG. 3, this temperature is 1750° F. (954° C.) and the voltage is approximately 5.5 volts.

A hysterisis circuit comprising a parallel circuit of a resistor R13 and capacitor C3 is connected between the comparator amplifier U2-B output and its non-inverting input. The purpose of the hysterisis circuit is to stabilize the comparator U2-B during switching when the tracking model 18 voltage exceeds the predetermined temperature level voltage.

The power switching transistor Q5 operates to supply gate voltage to the gate control transistor Q12. The power output transistor Q6 is controlled by the gate control transistor Q12 which when saturated due to a high signal on its gate grounds the bias supplied to the power output transistor Q6. This insures that the output of the power output transistor Q6 remains turned off when the ignition key is "OFF". The resistor R7 is connected directly to the battery to turn the gate control transistor Q12 on preventing the power output transistor Q6 from turning on.

In order to insure that the power output transistor Q6 will saturate, a voltage doubler circuit C6 is employed to put a higher voltage signal on the gate.

Figure 6:
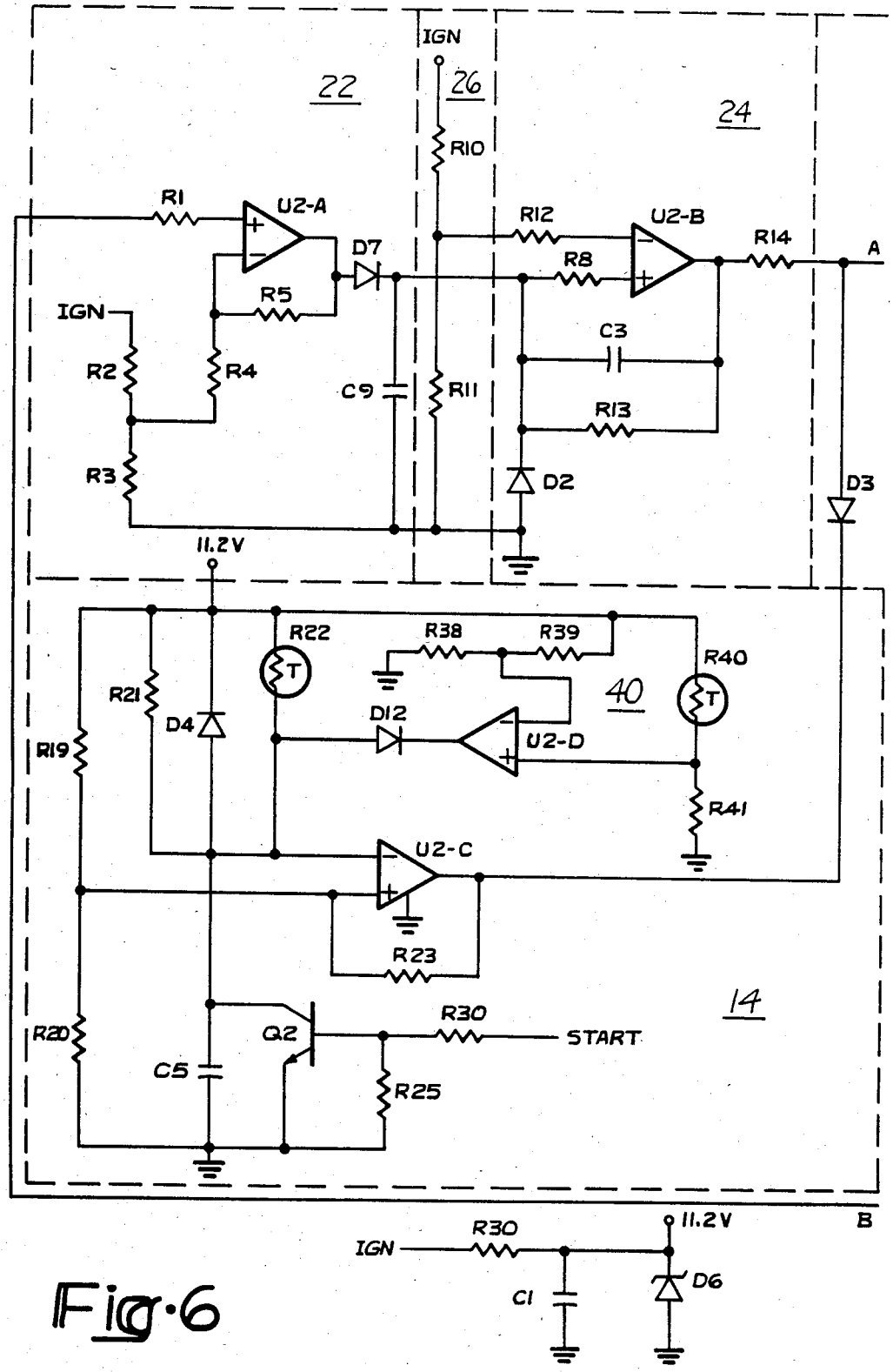
FIGS. 6 and 7 are schematics of an alternate embodiment of the electronic controller according to the present invention.
Figure 7:
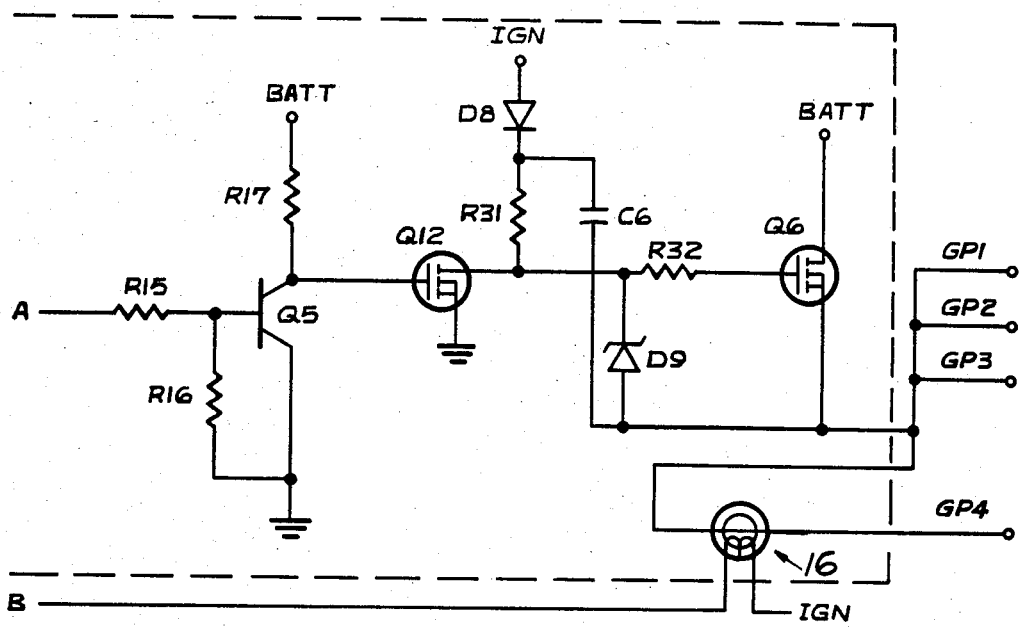

Referring to FIGS. 6 and 7 there is illustrated in schmatic form another embodiment of the solid state glow plug controller. The difference between the embodient shown in FIGS. 4 and 5 and the embodiment shown in FIGS. 6 and 7 is the use of a hall-effect device as the means to sense the temperature of the glow plug heater. As has been previously stated, the temperature of the glow plug heater is proportional to the amount of current being supplied to the heater. In a positive temperature coefficient heater as the temperature rises, the resistance of the heater increases and if the voltage is constant, the current is decreased. The opposite is, of course, true in a negative coefficient resistance heater where as the temperature rises the resistance decreases and the current increases.

For those systems where the glow plug heater is a positive temperature coefficient resistive heater the schematics of FIGS. 6 and 7 are applicable. As illustrated in FIG. 7, one of the leads to the glow plugs is selected to be the sense lead and to that lead a halleffect device 44 is coupled. The output of the hall-effect device 44 is electrically connected to the input resistor R1 to the non-inverting input of an operational amplifier U2-A. As previously discussed, the inverting inputs of the amplifier U2-A contain a voltage or current reference equal to the cold temperature resistance of the glow plug heater. The output of the amplifier is an electrical signal representing the temperature of the heater and is supplied through an input resistance R8 to the inverting input of the comparator U2-B. Electrically connected to the inverting input is a predetermined temperature reference voltage which predetermined temperature is the desired operating temperature of the glow plug heater. As the temperature of the glow plug increases, the amount of current being supplied to the glow plug decreases. The remainder portion of the circuit functions as stated for FIGS. 4 and 5.

Another embodiment of the sensing circuit illustrated in FIG. 7 would place a current transformer, not shown, in series with the glow plug. The output of the transformer is a current signal proportional to the current flowing through one winding of the transformer.

If a negative temperature coefficient heater were to be used, the principles and concepts of the glow plug controller as described herein would be applicable and the various polarities would be changed. In general, positive voltages would be negative and inverting inputs would be non-inverting inputs.

There has thus been shown and described a solid state, contactless adaptive controller for one or more glow plugs as found in a diesel engine. The adaptive aspect of the controller comes from the fact that the actual sampling power being supplied to the glow plug heater is used in a feedback mode to control the application of full power.

What is claimed is:

1. A glow plug controller for controlling the operating temperature of positive temperature coefficient glow plugs having fast thermal time constant characteristics, said controller comprising:

means for generating a predetermined voltage level wherein said level represents the operating temperature of the glow plugs;

sensing means operatively coupled to the glow plugs and responsive to the temperature of the glow plugs for generating an electrical signal having an amplitude directly proportional to said temperature;

tracking model means having a resistor and capacitor electrically connected to a source of power for alternately charging said capacitor to a voltage level equal to said predetermined voltage level and then discharging said capacitor to a voltage level equal to the amplitude of said sensing means, said tracking means having a charging time constant equal to or faster than the thermal time constant characteristic of the glow plugs;

comparator means responsive to said capacitor charging to said predetermined voltage level for generating a first level signal and responsive to said capacitor voltage level equal to said predetermined voltage level for generating a second level signal;

gate means responsive to said second level signal for discharging said capacitor to said amplitude of said sensing means; and power driver means electrically connected to a source of power and operable to supply the glow plugs with electrical power in response to said first level signal and to remove said electrical power in response to said second level signal.

2. The glow plug controller according to claim 1 additionally including:

means for generating an ignition signal for indicating when the glow plug controller is to be operated; and timing means responsive to said ignition signal for generating a time electrical signal having a predetermined time length representative of the operating time of the at least one glow plug.

3. The glow plug controller according to claim 2 additionally including reset means responsive to a start signal for generating a second time electrical signal having a predetermined time length for actuating said sensing means and said power supply means immediately upon the termination of said ignition signal for determining the initial temperature of the at least one glow plug heater.

4. The glow plug controller according to claim 1 additionally including means responsive to ambient temperature for inhibiting said power supply means from applying power to the at least one glow plug heater when the ambient temperature exceeds a predetermined value.

* * * * *